US005938069A

United States Patent [19]

Macchia

[11] Patent Number: 5,938,069

[45] Date of Patent: Aug. 17, 1999

[54] TELEPHONE DISINFECTING TOWELETTE AND DISPENSER

[76] Inventor: Joe Macchia, 47 Alta Ave., Yonkers, N.Y. 10705

[21] Appl. No.: 08/898,669

[22] Filed: Jul. 22, 1997

[51] Int. Cl.[6] ..... A47K 10/24

[52] U.S. Cl. ..... 221/48; 221/63; 206/494

[58] Field of Search ..... 221/135, 33, 45, 221/48, 50, 63; 206/210, 409, 410, 494, 812

[56] References Cited

U.S. PATENT DOCUMENTS

| | | | |
|---|---|---|---|
| 3,239,097 | 3/1966 | Bates et al. | 221/48 |
| 3,775,801 | 12/1973 | Walker | 15/104.93 |
| 4,185,754 | 1/1980 | Julius | 221/63 |
| 4,219,129 | 8/1980 | Sedgwick | 221/63 |
| 4,837,079 | 6/1989 | Quantrille et al. | 428/288 |
| 5,213,884 | 5/1993 | Fellows | 428/240 |
| 5,320,772 | 6/1994 | Tricca | 252/160 |
| 5,547,601 | 8/1996 | Volpe | 15/104.93 |

*Primary Examiner*—Kenneth Noland
*Attorney, Agent, or Firm*—Michael I. Kroll

[57] ABSTRACT

A combination telephone disinfecting towelette and dispenser for dispensing individual telephone disinfecting towelettes. The combination includes a plurality of telephone disinfecting towelettes each being treated with a disinfectant and in a layered interlocking position with an adjacent one of the plurality of telephone disinfecting towelettes. The plurality of telephone disinfecting towelettes are positioned within the dispenser. The dispenser includes a cylindrical shell including a sealed bottom side and a top side including a recess therein and a device for releasably sealing the recess. The dispenser further includes a device for dividing the dispenser into first and second sections, hermetically sealing the plurality of telephone disinfecting towelettes within the second section whereby a top one of the plurality of telephone disinfecting towelettes extends through the dividing device and into the first section where it may be removed from the dispenser through the recess.

4 Claims, 7 Drawing Sheets

TELEPHONE DISINFECTING TOWELETTE AND DISPENSER

BACKGROUND OF THE INVENTION

1. Field of the Invention

The present invention relates generally to disinfecting devices and, more specifically, to a telephone disinfecting towelette and dispenser for readily providing individual telephone disinfecting towelettes for use in disinfecting a telephone, the dispenser retaining unused towelettes therein.

2. Description of the Prior Art

Numerous devices for disinfecting objects such as telephones have been provided in the prior art. For example, U.S. Pat. Nos. 3,775,801; 4,837,079; 5,213,884; 5,320,772 and 5,547,601 all are illustrative of such prior art. While these units may be suitable for the particular purpose to which they address, they would not be as suitable for the purposes of the present invention as heretofore described.

A dispenser for a moist flexible sheet material for medical and similar purposes comprising a normally closed container into which the material is either inserted in a moist condition, preferably in the form of a roll, or into which a treating liquid is poured so as to moisten the sheet material while being unwound from a dry roll when it is withdrawn through a narrow slot in the container wall and a sheet of the desired length is then torn or cut off by a cutting edge or a a cutting blade.

An antimicrobially active, non-woven web, a wet wiper containing the web, and a method of making the web. The method includes the steps of forming an unbounded fibrous web; applying throughout the unbonded fibrous web an uncured binder and polyhexamethylene biguanide hydrochloride as an antimicrobial agent, the antimicrobial active agent being substantively to the fibers of the web and to the binder; and curing the binder material to bind the fibers together to form an antimicrobially active, non-woven web.

The present invention relates to a tissue suitable for use in the disinfection of hard surfaces, instruments and human or animal skin or as a sheet inclusion in a washing process for the purpose of disinfection or bleaching. The tissue comprises first and second substrate layers which are bonded together with an adhesive polymer. This polymer also retains solid particles between the layers, which particles, when dampened with a suitable liquid become active and release chlorine. Preferably, the adhesive polymer comprises either a copolyester, copolyamide or polyethylene hot melt adhesive powder or an ethylene vinyl acetate (EVA) or modified EVA hot melt adhesive powder with a particle size between 0 and 750 microns inclusive. Preferably also, the chlorine release agent comprises sodium dichloroisocyanurate dihydrate which is mixed with the adhesive polymer and applied between the substrate layers in coating weights between 2 and 35 grams per square meter inclusive to yield active solutions of between 10 and 10,000 parts per million available chlorine when the tissue is dampened with water.

A cleaning composition for cleaning the surfaces of edible fresh fruits and vegetables. The composition comprises water and a preservative, and preferably also a co-solvent with a dielectric constant less than that of water, a surfactant, a flavorant, and a buffering agent to maintain the composition's pH within the range of 2 to 9. The invention further comprises a fibrous wiper impregnated with the cleaning composition for wiping the fresh produce, and a dispenser for storing the impregnated fibrous wiper.

A presaturated wipe for cleaning the surface of a surface mount technology board, towels or wipes are saturated with a combination of 95 weight percent glycol ethers and less than 5 weight percent alcohol, the boards are cleaned with the presaturated wipe and do not require a rinse.

SUMMARY OF THE PRESENT INVENTION

The present invention relates generally to disinfecting devices and, more specifically, to a telephone disinfecting towelette and dispenser for readily providing individual telephone disinfecting towelettes for use in disinfecting a telephone, the dispenser retaining unused towelettes therein.

A primary object of the present invention is to provide a telephone disinfecting towelette and dispenser that will overcome the shortcomings of prior art devices.

Another object of the present invention is to provide a telephone disinfecting towelette and dispenser which is able to disinfect a telephone, eliminating germs deposited by a previous user.

A further object of the present invention is to provide a telephone disinfecting towelette and dispenser which is able to retain telephone disinfecting towelettes in a moist condition within the dispenser.

An additional object of the present invention is to provide a telephone disinfecting towelette and dispenser including a hermetically sealed top for protecting the telephone disinfecting towelettes from air borne contaminants while retaining the telephone disinfecting towelettes therein from drying out.

A further object of the present invention is to provide a telephone disinfecting towelette and dispenser able to dispense telephone disinfecting towelettes one at a time.

A yet further object of the present invention is to a telephone disinfecting towelette and dispenser including an overlapping membrane separating the dispenser into two compartments for enhancing the storage ability of the device.

Another object of the present invention is to provide a telephone disinfecting towelette and dispenser that is simple and easy to use.

A still further object of the present invention is to provide a telephone disinfecting towelette and dispenser that is economical in cost to manufacture.

Additional objects of the present invention will appear as the description proceeds.

A combination telephone disinfecting towelette and dispenser for dispensing individual telephone disinfecting towelettes is disclosed by the present invention. The combination includes a plurality of telephone disinfecting towelettes each being treated with a disinfectant and in a layered interlocking position with an adjacent one of the plurality of telephone disinfecting towelettes. The plurality of telephone disinfecting towelettes are positioned within the dispenser. The dispenser includes a cylindrical shell including a sealed bottom side and a top side including a recess therein and a device for releasably sealing the recess. The dispenser further includes a device for dividing the dispenser into first and second sections, hermetically sealing the plurality of telephone disinfecting towelettes within the second section whereby a top one of the plurality of telephone disinfecting towelettes extends through the dividing device and into the first section where it may be removed from the dispenser through the recess.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
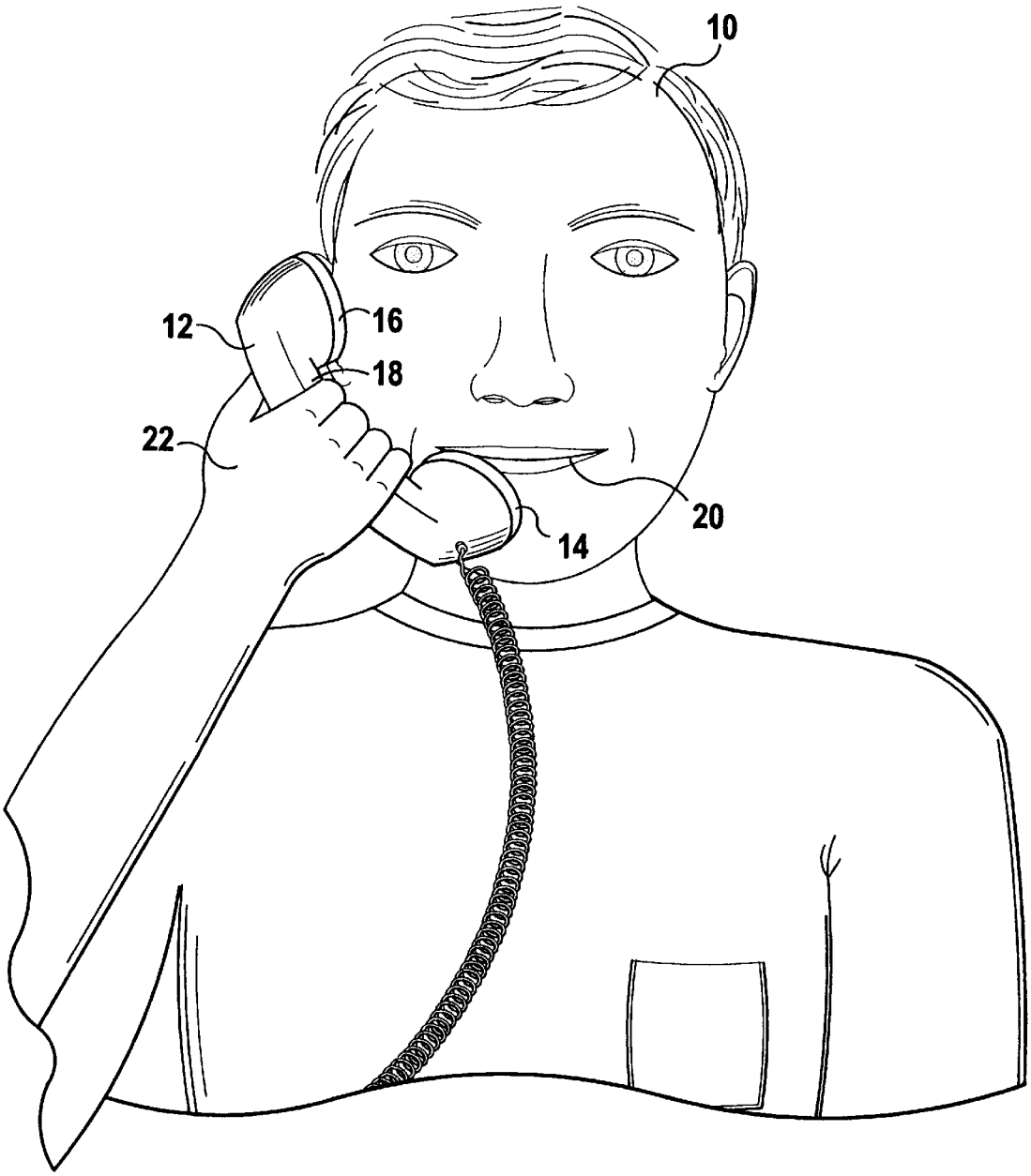
FIG 1 (PRIOR ART)
FIG. 1 is a front perspective view of a person using a telephone to illustrate possible areas of telephone contamination from normal use.
Figure 2:
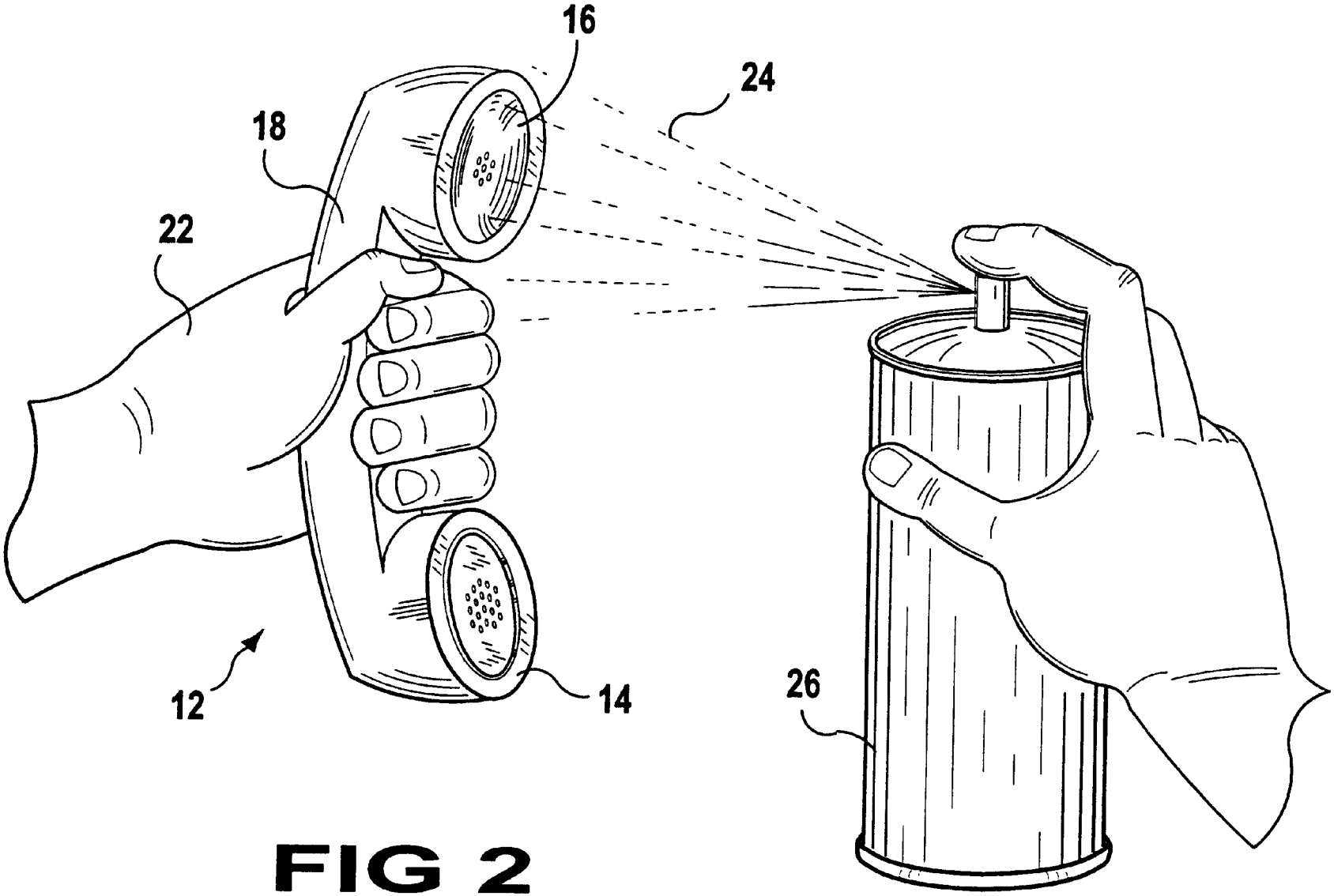
FIG. 2 is a perspective view of a prior art method of disinfecting a telephone.

Turning now descriptively to the drawings, in which similar reference characters denote similar elements throughout the several views, the Figures illustrate the telephone disinfecting towelette and dispenser of the present invention. With regard to the reference numerals used, the following numbering is used throughout the various drawing figures.

10 user of telephone
12 telephone
14 microphone of telephone
16 speaker of telephone
18 handle of telephone
20 mouth of user
22 hand of telephone user
24 disinfectant
26 disinfectant spray can
28 dispenser of the present invention
30 cylindrical midsection of dispenser
32 top side of dispenser
34 bottom side of dispenser
36 cover
38 hinge
40 sealing device
42 recess extending through top side
44 lip extending around outer periphery of sealing device
46 latch of cover
48 skirt extending from cover
50 protrusion extending around inner side of skirt
52 telephone disinfecting towelette
54 first sealing layer
56 second sealing layer
58 upper chamber of dispenser
60 lower storage chamber of dispenser

DETAILED DESCRIPTION OF THE PREFERRED EMBODIMENT

Turning now descriptively to the drawings, in which similar reference characters denote similar elements throughout the several views, FIG. 1 illustrates a person indicated generally by the numeral 10 using a telephone handset 12 in a conventional manner. The telephone handset 12 includes a microphone 14 into which a user speaks, a speaker 16 for listening to a person on an opposing end of a conversation and a handle 18 connected between the microphone 12 and speaker 14 for holding the handset 12.

Figure 3:
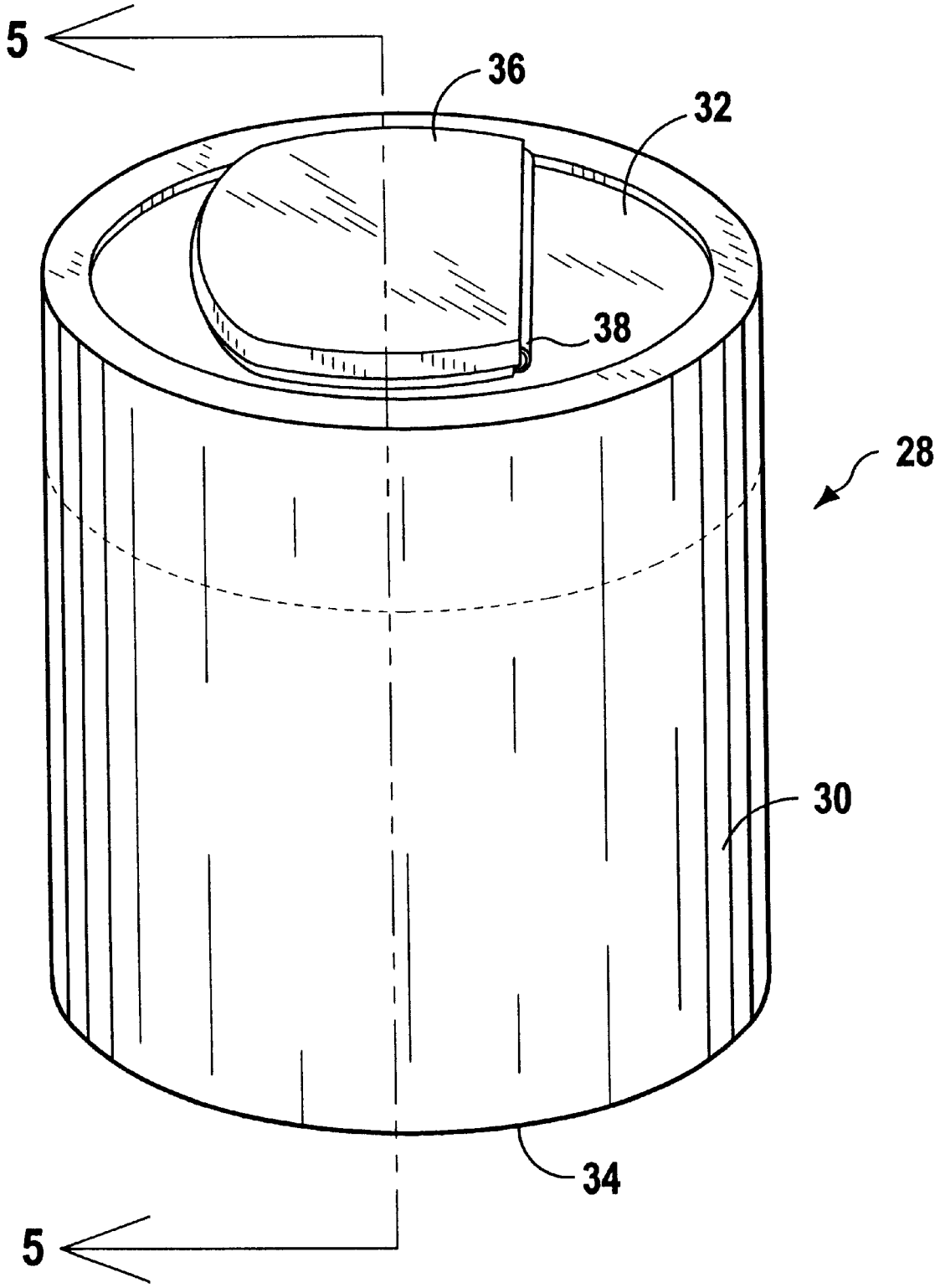
FIG. 3 is a front perspective view of the telephone disinfecting towelette and dispenser of the present invention.

When in use, a telephone handset 12 will be exposed to germs and other contaminants. Such contaminants include germs from the user's mouth 20 on the microphone 14, germs from the user's hands 22 on the handle 18 and particles and contaminants in the user's hair and on the user's ear and face on the speaker 16. In order to sanitize a telephone 12 from the germs to which it is exposed, the telephone 12 was normally sprayed with a disinfectant 24 from a deodorizing can 26. The problem with this method of disinfecting a telephone 12 is that when the disinfectant 24 is sprayed towards the telephone 12 the spray can come into contact with both the microphone 14 and speaker 16 through holes in the handset housing increasing the possibility of damaging the internal components of the telephone 12 causing it to malfunction. Furthermore, such disinfectants may contain fluorocarbons (CFCs) which cause damage to the ozone layer. Thus, the known methods of disinfecting telephones is damaging to the telephone itself and is also unsafe for the environment FIGS. 3 through 7 illustrate a telephone disinfecting towelette and dispenser in accordance with the present invention, the dispenser is indicated generally by the numeral 28. The dispenser 28 for dispensing the telephone disinfecting towelette includes a cylindrical shell 30 having a top side 32 and a bottom side 34 as shown in FIG. 3. The bottom side 34 is sealed to prevent access to the cylindrical shell 30 therethrough and aid in retaining telephone disinfecting towelettes therein free from germs and separated from the surrounding atmosphere to prevent drying out caused thereby. The top side 32 includes a cover 36 for sealing the top side 32 of the dispenser 28 closed. The cover 36 is connected thereto by a hinge mechanism 38. The cover 36 includes a skirt 48 extending from the outer periphery thereof and a protrusion 50 extending around an inner side of the skirt 48. A tab 46 is provided to extend from the cover 36 for lifting the cover 36 from its closed position sealing the dispenser 28.

Figure 4:
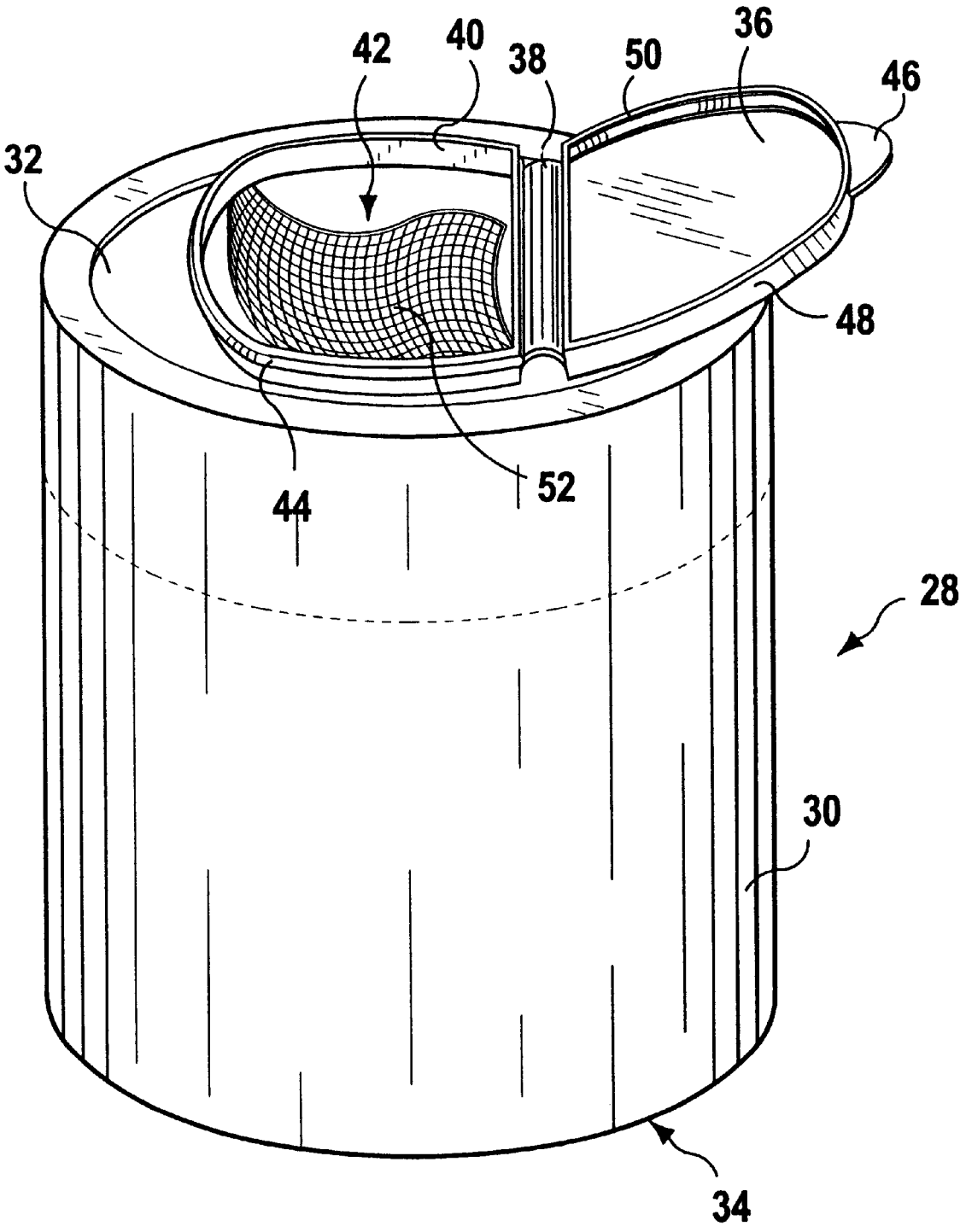
FIG. 4 is a front perspective view of the telephone disinfecting towelette and dispenser of the present invention in an open position.

The cover 36 may be fastened closed via an engagement with a sealing device 40 connected to the top side 32 and positioned to cover a recess 42 extending through the top side 32, as illustrated in FIG. 4. The sealing device 40 extends from the top side 32 and includes a lip 44 extending around a outer periphery thereof. The recess 42 is accessible through the sealing device 40. When the dispenser 28 is sealed closed, the protrusion 50 is caused to be positioned between the lip 44 and the top side 32 and engage an underside of the lip 44. Towelettes 52, extend through the recess 42 one at a time for removal from the dispenser 28.

Figure 5:
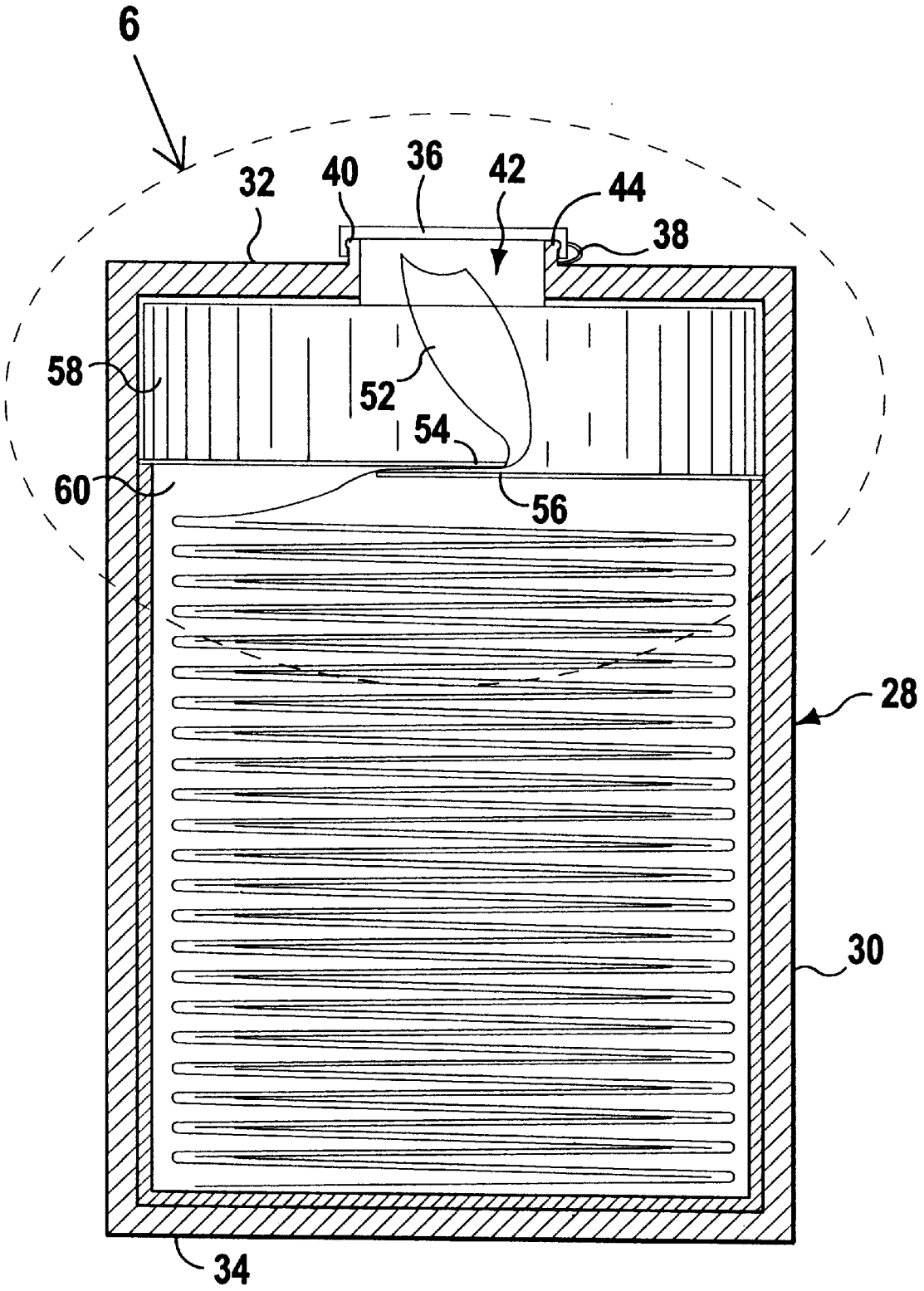
FIG. 5 is a cross-sectional view of the telephone disinfecting towelette and dispenser of the present invention taken along the line 5—5 of FIG. 3.

A cross sectional view showing the layered interrelationship between the towelettes 52 is illustrated in FIG. 5. As can be seen the dispenser 28 is separated into an upper chamber 58 and a lower chamber 60 by a first upper flexible layer 54 which forms an overlapping relationship with a second lower flexible layer 56. The first upper flexible layer 54 and second lower flexible layer 56 are preferably a latex membrane which is flexible to allow the telephone disinfecting towelettes 52 to pass therebetween when a removal force is applied to the towelette 52. The latex membranes 54 and 56 return to their rest position sealing the second lower chamber 60 from exposure to the atmosphere and retaining the telephone dispensing towelettes therein with the top telephone disinfecting towelette 52 partially extending between the membranes and into the first upper chamber 58. Thus the top telephone disinfecting towelette 52 can be removed by an applying an adequate removal force away from the membranes 54 and 56 and towards the recess 42. Due to the layered interrelationship of the telephone disinfecting towelettes 52 when the top telephone disinfecting towelette 52 is removed the telephone disinfecting towelette 52 adjacent to and immediately therebelow will be caused to replace the telephone disinfecting towelette 52 which was removed. The physical properties and characteristics of the membranes 54 and 56 form a hermetically sealed lower chamber 60 and thus retain the remaining telephone disinfecting towelettes 52 in a moist condition maintaining their disinfecting quality. The first and second membranes are preferably made of latex, rubber any combination thereof or any material which is able to perform the necessary functions of hermetically sealing the telephone disinfecting towelettes from exposure to the atmosphere while remaining flexible and able to return to its original at rest position after a force applied thereto is removed.

Figure 6:
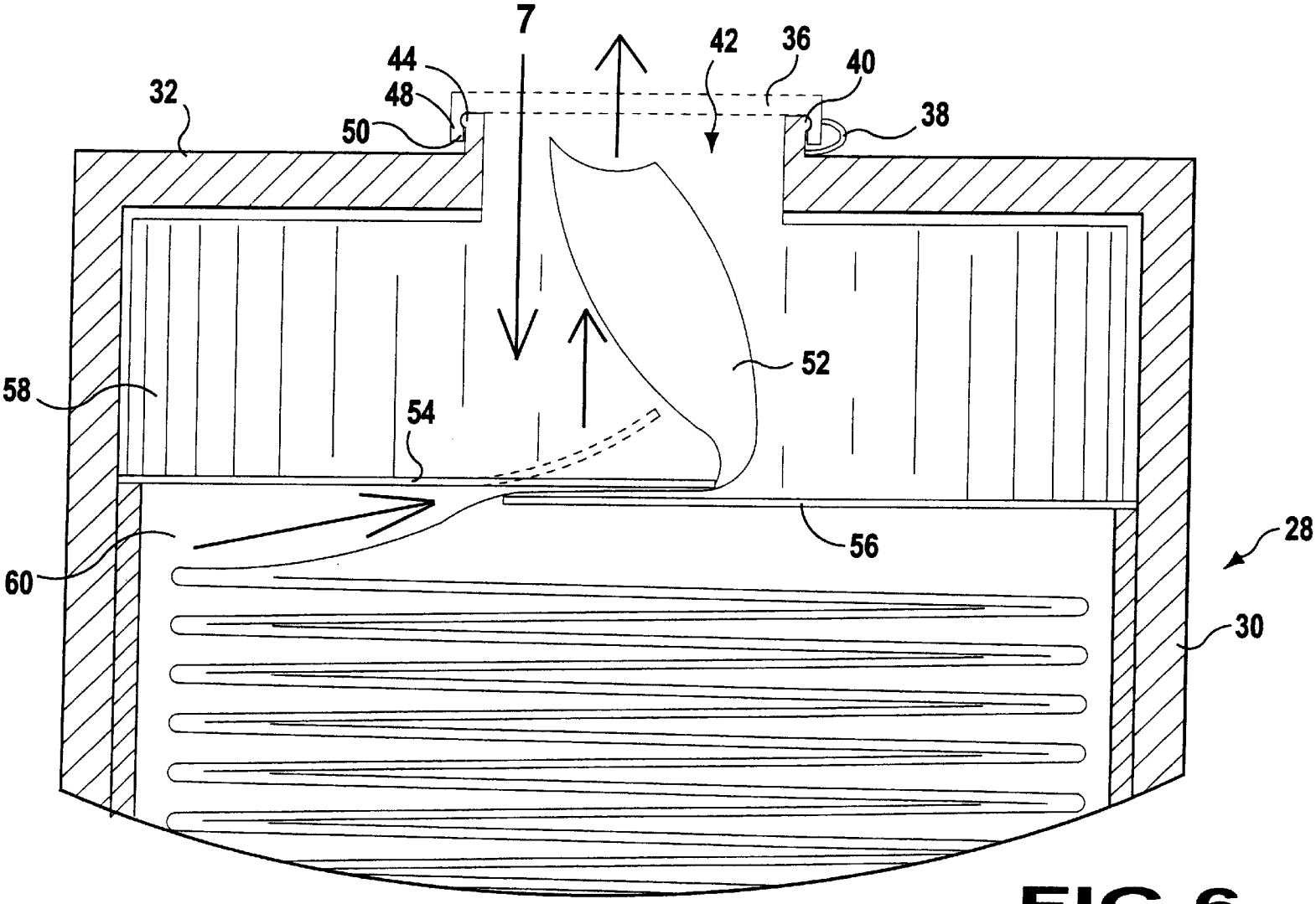
FIG. 6 is an exploded cross-sectional view of the overlapping membrane of the telephone disinfecting towelette and dispenser of the present invention taken within the circle labeled 6 of FIG. 5.
Figure 7:
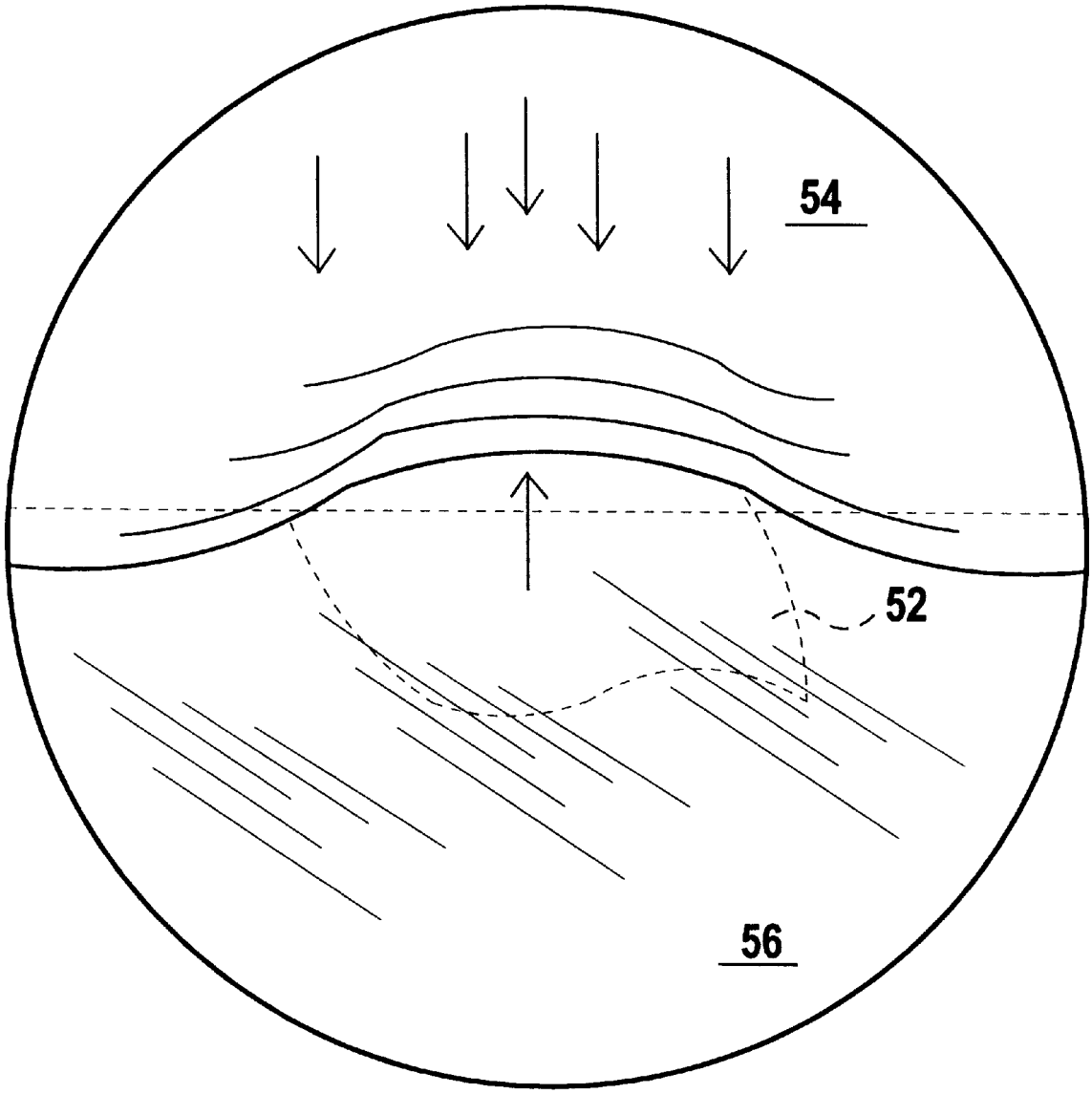
FIG. 7 is a top view of the telephone disinfecting towelette and dispenser of the present invention taken in the direction of the arrow labeled 7 of FIG. 6.

FIGS. 6 and 7 illustrate the movement of the membranes 54 and 56 as a telephone disinfecting towelette 52 is removed from the dispenser 28. FIG. 6 illustrating a side cross sectional view while FIG. 7 illustrates a top view. As can be seen from the figures, when a removal force is applied to the top telephone disinfecting towelette, the top membrane 54 is pulled towards the recess 42 with the top telephone disinfecting towelette 52 while the lower membrane 56 remains substantially stationary. The top telephone disinfecting towelette 52 is interlayered with a telephone disinfecting towelette 52 immediately therebelow and pulls that telephone disinfecting towelette 52 partially through the space between the membranes 54 and 56. When the top telephone disinfecting towelette is removed the top membrane 54 returns back to its rest position, the telephone disinfecting towelette 52 pulled partially therethrough now positioned between the upper and lower membranes 54 and 56.

While a preferred form for dividing said dispenser into first and second sections and hermetically sealing said plurality of telephone disinfecting towelettes within said second section of the dispenser is shown and described herein, those of ordinary skill in the art who have read this description will appreciate that there are numerous other mechanisms dividing said dispenser into first and second sections and hermetically sealing said plurality of telephone disinfecting towelettes within said second section of the dispenser dividing said dispenser into first and second sections, hermetically sealing said plurality of telephone disinfecting towelettes within said second section of the dispenser and, therefore, as used herein the phrase "means for dividing said dispenser into first and second sections and hermetically sealing said plurality of telephone disinfecting towelettes within said second section of the dispenser" should be construed as including all such mechanisms as long as they achieve the desired result of sealing a section of the dispenser retaining the towelettes therein, and, therefore, that all such alternative mechanisms are to be considered as equivalent to the one described herein.

In operation, the telephone disinfecting towelettes 52 are layered in an interlocking fashion and positioned within the lower chamber 54 of the dispenser 28. A top one of the telephone disinfecting towelettes 52 extends between the membranes 54 and 56 of the divider and into the upper chamber 58 where it may be accessed through the recess 42.

In order to retrieve one of the telephone disinfecting towelettes 52, a user must release the cover 36 from its engagement with the sealing device 40 by exerting an upward force away from the dispenser 28 on the latch 46 of the cover 36. The user now has access to the top telephone disinfecting towelette 52. To remove the top telephone disinfecting towelette 52 an upward force is applied away from the divider causing the top membrane 54 of the divider to be raised and top telephone disinfecting towelette 52 to be released from between the membranes 54 and 56 of the divider. Due to the interlocking relationship between the top telephone disinfecting towelette 52 and an adjacent telephone disinfecting towelette 52 the adjacent telephone disinfecting towelette 52 is caused to be pulled between the membranes 54 and 56 of the divider and extend into the upper chamber 58. The top membrane 54 is caused to return to its rest position hermetically sealing the remainder of the telephone disinfecting towelettes 52 within the lower chamber 60 and the new top telephone disinfecting towelette 52 extending between the membranes and partially into the upper chamber 58. The cover 36 is now pivoted towards the sealing device 40 and pressure is applied to engage the protrusion 50 with the underside of the lip 44 to seal the dispenser 28 shut until it is desired to remove another telephone disinfecting towelette 52.

From the above description it can be seen that the telephone disinfecting towelette and dispenser of the present invention is able to overcome the shortcomings of prior art devices by providing a telephone disinfecting towelette and dispenser which is able to disinfect a telephone, eliminating germs deposited by a previous user and retain telephone disinfecting towelettes in a moist condition within the dispenser. The telephone disinfecting towelette and dispenser includes a hermetically sealed top for protecting the telephone disinfecting towelettes from air borne contaminants while retaining the telephone disinfecting towelettes therein from drying out. The telephone disinfecting towelette and dispenser is also able to dispense telephone disinfecting towelettes one at a time. telephone disinfecting towelette and dispenser including an overlapping membrane separating the dispenser into two compartments for enhancing the storage ability of the device. Furthermore, the telephone disinfecting towelette and dispenser of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A combination telephone disinfecting towelette and dispenser for dispensing individual telephone disinfecting towelettes, comprising:

a) a cylindrical shell including a sealed bottom side and a top side including a recess therein;

b) means for releasably sealing said recess;

c) means for dividing the inside of said cylindrical shell into a first section adjacent said recess and a second section separated from said recess by said first section and forming a hermetic seal between said sections, said second section containing interlocking towelettes, each of said towelettes being U-shaped with two legs, each of said legs extending over the legs of oppositely facing adjacent towelettes, and each of said towelettes being premoistened with a disinfectant;

d) said dividing means comprising a pair of partially overlapping first and second layers with said layers being made of flexible material and said first layer being biased in the direction of making contact with said second layer, said first layer being on the side of said dividing means facing said recess;

e) a leg of a first towelette extending around said second layer in contact with facing surfaces of said first and second layers and extending into said first section where said leg can be reached when said recess is opened, said first and second layers normally sandwiching said leg of the first towelette for maintaining said hermetic seal, so that pulling said leg of said first towelette out through said recess bends said first layer and pulls along the leg of the next interlocked towelette with the leg of said next interlocked towelette left extending out into said first section when said first towelette is removed, said first layer closing back on said second layer with the leg of said next towelette sandwiched therebetween to maintain the hermetic seal of said second section and resealing of said recess protects the leg of the next towelette extending into said first section.

2. The combination telephone disinfecting towelette and dispenser as recited in claim 1, wherein said flexible material is one of latex, rubber and any combination thereof.

3. The combination telephone disinfecting towelette and dispenser as recited in claim 1, wherein said means for releasably sealing said recess includes a means for covering said recess, means for latching said cover in a closed position and hinge means for pivotally connecting said means for covering to said means for latching.

4. The combination telephone disinfecting towelette and dispenser as recited in claim 3, wherein said means for covering includes a cover plate, a skirt depending from said cover plate and a protrusion extending around an inner periphery of said skirt; and said means for latching is connected to extend from said recess and includes a lip extending around an outer periphery thereof, wherein said means for releasably sealing is operable between a first closed position in which said protrusion is positioned between said lip and said top side so as to engage with an underside of said lip and a second open position in which said cover plate extends at an angle to said means for latching to thereby provide access to said top telephone disinfecting tissue through said recess.

* * * * *